United States Patent [19]

Yoneda et al.

[11] 4,266,632

[45] May 12, 1981

[54] ELEVATOR SYSTEM

[75] Inventors: Kanji Yoneda; Takeo Yuminaka; Masao Nakazato, all of Katsuta, Japan

[73] Assignee: Hitachi, Ltd., Tokyo, Japan

[21] Appl. No.: 4,878

[22] Filed: Jan. 19, 1979

[30] Foreign Application Priority Data

Jan. 20, 1978 [JP] Japan ..... 53/4261

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 4,106,593 | 8/1978 | Otto et al. | 187/29 |
| 4,114,730 | 9/1978 | Means et al. | 187/29 |
| 4,128,143 | 12/1978 | Petterson et al. | 187/29 |

*Primary Examiner*—J. V. Truhe
*Assistant Examiner*—W. E. Duncanson, Jr.
*Attorney, Agent, or Firm*—Craig and Antonelli

[57] ABSTRACT

An elevator system has a system control device for controlling a plurality of elevator cars and elevator car operation control devices for operatively controlling each of said elevator cars in accordance with signals issued in the system control device.

At least one of the elevator car operation control devices includes an interface unit to receive hall-call signals issued in said hall-call registration device and a signal processor to supply the signals delivered from the interface unit to said system control device, to be supplied the signals treated in said system control device and to supply treated signals to an elevator car operation control section constituting a part of said elevator car operation control device.

17 Claims, 20 Drawing Figures

ELEVATOR SYSTEM

BACKGROUND OF THE INVENTION

The present invention relates to an elevator system and especially a system for controlling a plurality of parallel elevators.

With the spread of elevator and in accordance with the current tendency of loftiness of building, there is an increasing demand for a higher reliability for the elevator controller, not to mention the safety, because the elevator has an important role of a vertical transportation means of the whole building.

In addition, the steady progress of the technique has brought about improved durability of the building and the elevator itself. Consequently, it is often experienced that the elevator controller is repaired or renewed before the lives of the building and the elevator expire. More specifically, there are many cases that an elevator car control device or a system control device which have worked ten years or so. Generally, in such a case, whole part of the elevator controller, which weighs tens of hundred kilogrammes to 1 ton is renewed with new one assembled in the factory. The entire elevator system has to be stopped during such a replacement which takes a considerably long time.

In addition, if a trouble is caused in the system control device, the whole elevator system becomes inoperative and unserviceable. Such an inconvenience has to be overcome.

Further, the replacement or renewal of the hall-call register, due to breakage of malfunctioning of the same, and the protective maintenance of the system control device have to be done in the nighttime in which there is no traffic demand. This problem is serious particularly when the number of elevators to be maintained is large.

Hereinafter, shortcomings or problems of the prior art will be described.

Suppose an elevator system has parallel elevator cars. These elevator cars are adapted to be controlled by respective elevator car control devices to which electric power for driving respective elevator cars is supplied from respective lead-in power supplies.

Referring first to the reliability of operation of the elevator system, it is to be pointed out that whole part of the elevator system becomes inoperative, if a breakdown takes place in the system control device, since the interface controlling circuit is combined in the system control device. Further, if there is any trouble in the common power supply circuit or in the hall-call registers or in the observation panel, whole or a part of the elevator system becomes out of use. Since in most cases there is no system backup for supporting the elevator control system, the only measure left for improving the reliability of the elevator system is to enhance the reliabilities of respective parts of the elevator system.

As a matter of fact, however, the control system consists of some hundreds of relays or incorporates micro-processors the reliability of which has not been settled yet. Consequently, the control system is not always reliable enough. In addition, since the construction of the control system is highly complicated, the down time inevitably becomes long, in case of a breakdown of the control system. This causes a serious problem because all of the elevator cars cannot respond to the hall-call during such a long down time.

Referring now to the renewal of part of the control system and to the protective maintenance of the same, the number of signals exchanged between the elevator car control devices and the system control device is about 200 to 300 for each elevator car, when the number of floors is 15 or so, although it depends on the kind of controlling system and the number of floors served by the elevator cars.

Recently, an improved elevator controlling system has been proposed, in which for the adoption of IC for serial transmission, the above-mentioned large number of signals are transmitted through only several wires. By adopting this newly developed technique, it is possible to minimize the number of wires between the control devices.

However, it is not impossible to eliminate some 200 to 300 lines interconnecting each elevator controller, and the elevator car, motor and its accessories in the machinery room and safety switches, position detectors and so forth in the elevator shaft. Therefore, it takes a long time for renewing the elevator car control device. In addition, it is almost impossible to install the terminals on the newly assembled elevator car operaion control device in the order strictly identical to that of the old elevator car operation control device to be removed. It is therefore necessary to alter the wiring suitably to meet the terminal arrangement of the newly assembled elevator car operation control device when the latter is installed. Further, the correct connection of the wiring must be confirmed after the completion of the work, through a strict inspection and trial.

Usually, the common power supply circuit and the whole or a part of managing and controlling circuit are installed in the same cubicle with the car operation control devices. It is therefore necessary to cut off the power supply to all elevator cars, when one of the cars is repaired or renewed.

As to the standardization of the elevator car operation control device the hall-call signal is delivered to the system control device in case that the elevator system has a plurality of parallel elevator cars. However, in case the elevator system has only one elevator car, it is necessary to install the hall-call interface controlling circuit and hall-call registration circuit within the elevator car operation control device because in such a case there is no system control device.

To cope with above-stated two different kinds of demand, it has been necessary to design and produce two types of elevator car operation control devices for a single elevator and parallel elevators, resulting in a raised cost of design and administration, which is quite inconvenient from the view point of mass production. Regarding an elevator system it has been proposed as described in Japanese laid-open patent application No. 51 (1976)-53354 and corresponding U.K. Pat. No. 1515339 to provide with interface controlling means constituting a part of system control device, which directly takes up the hall-call singnals from a hall-call register located on every floor to register the hall-calls.

Further, regarding an elevator system it has been proposed as described in Japanese laid-open patent application 49 (1974)-126054 and corresponding U.S. Pat. No. 3854554, to provide with interface controlling means constituting a part of system control device. According to the construction as above-described, it is to be pointed out the whole part of the elevator system becomes inoperative, if a breakdown takes place in the system control device, since the interface controlling means is combined in the system control device. Further it is unconvenient to make the renewal of the car operation control device or the system control device and the maintenance of the same, and it is impossible to provide the commonness for a single elevator and parallel elevators to effect the standardization of the elevator car operation control devices.

SUMMARY OF THE INVENTION

It is therefore a object of the invention to provide an elevator system for controlling a plurality of parallel elevators, which is less likely to cause breakdown and has a high reliability, and which affords an easy standardization of the elevator car operation control devices.

It is another object of the invention to provide an elevator system which can make easier and faster the renewal of an elevator car operation control device or a system control device of elevator cars, and the protective maintenance of the same.

According to the invention, at least one of a plurality of elevator car operation control devices is provided with an interface circuit, so that the hall-call signal derived from the hall-call register is delivered to the car operation control device through this interface circuit. The elevator car operation control device is provided with a signal processor to supply the hall-call signals to the system control device as well as to deliver the signals treated in the system control device to a control section of the elevator.

Further, the interface means is connected to the hall-call register through a disconnectable connector and disconnectably disposed in the car operation control device which is connected to the system control device through a disconnectable connector.

According to the present invention, there is provided an elevator system, comprising:

a structure having a plurality of floors, a plurality of elevator cars mounted for movement relative to the floors, system control means for controlling said plurality of elevator cars, elevator car operation control means for operatively controlling each of said elevator cars in accordance with signals treated in and delivered from said system control means, hall-call registration means to register calls for service from the floors, said elevator car operation control means including interface means to receive hall-call signals issued in said hall-call registration means and a signal processor to supply the signals delivered from the interface means to said system control means, to be supplied the signals treated in said system control means and to supply treated signals to an elevator car operation control section in said elevator car operation control means.

DETAILED DESCRIPTION OF THE DRAWINGS

Figure 1:
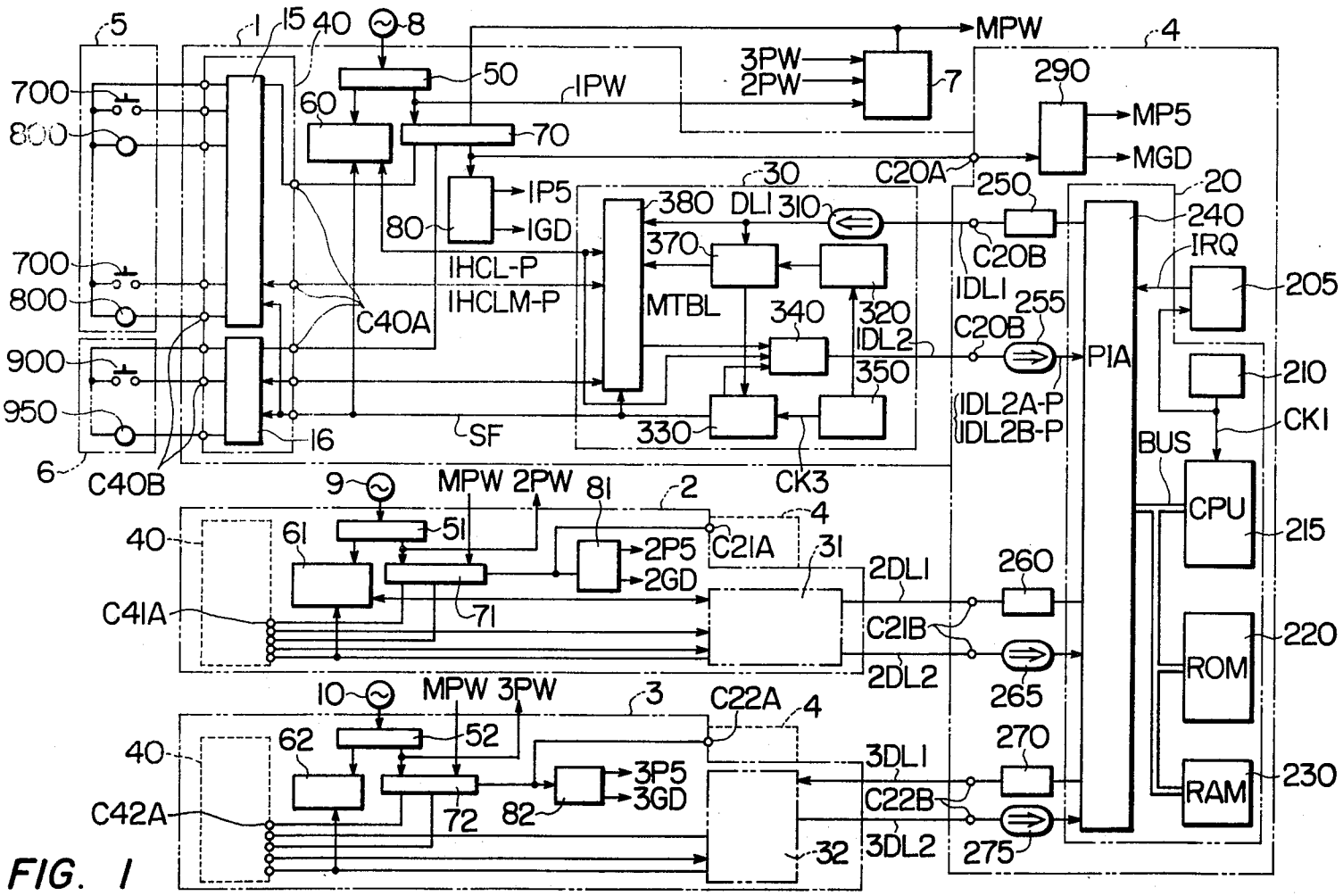
FIG. 1 is a block diagram of a system in accordance with the invention for controlling parallel elevators.

Hereinafter, the whole construction of a practical embodiment of the invention, as well as advantages derived therefrom, will be described with specific reference to FIG. 1.

The elevator system includes a group of elevator cars (not shown).

An elevator car operation control device 1 has a signal processor 30, an interface unit 40, an electric source circuit 50 connected to a leadin power supply 8, an elevator car operaiton controlling section 60, a signal power source circuit 70 and a D.C. automatic voltage regulating circuit 80. An elevator car operation control device 2 has a signal processor 31, an electric source circuit 51 connected to a lead-in power supply 9, an elevator car operation controlling section 61, a signal power source circuit 71 and a D.C. automatic voltage regulating circuit 81. Further, an elevator car operation control device 3 has a signal processor 32, an electric source circuit 52 connected to a lead-in power supply 10, an elevator car operation controlling section 62, a signal power source circuit 72 and a D.C. automatic voltage regulating circuit 82.

Corresponding to the elevator car operaton control device 1, there are provided a system control device 4, a hall-call registor 5 and an observation panel 6.

Since every car in the group of elevator cars and the elevator car operation control devices are same in the constitution and function, the elevator car operation control device 1 will be described in details hereinafter.

A hall-call to be registered by hall-call buttons 700 mounted on every floor is registered in the hall-call registor 5 and the so obtained hall-call information is delivered through a disconnectable connector C40B to the hall-call interface controllng device 15, which has a function to deliver a pulse 1 HCL-P to a memory circuit 380 in the signal processor 30 through a disconectable connector C40A. A hall-call registering signal 1 HCLM-P is delivered from the memory circuit 380 and drives a reply lamp 800 located on the corresponding floor through the interface controlling circuit 15. The observation panel 6 has many switches 900 and indication lamps 950, and is located in a management room or a protective center in a building. Upon the observation, the switch 900 is put in the state of ON and the signal is delivered to the observation panel interface controlling circuit 16 through a disconnectable connector C40B and further to the memory circuit 380. The observation signal delivered from the memory 380 drives a reply lamp 950 through the observation panel interface conthe foregoing item (1), the elevator system as shown in FIG. 1 is rather superior to that of conventional arrangement, because one of the three elevators can serve for the hall-call.

A preferred embodiment will be described in more detail mainly with reference to FIGS. 1 to 12.

Figure 2:
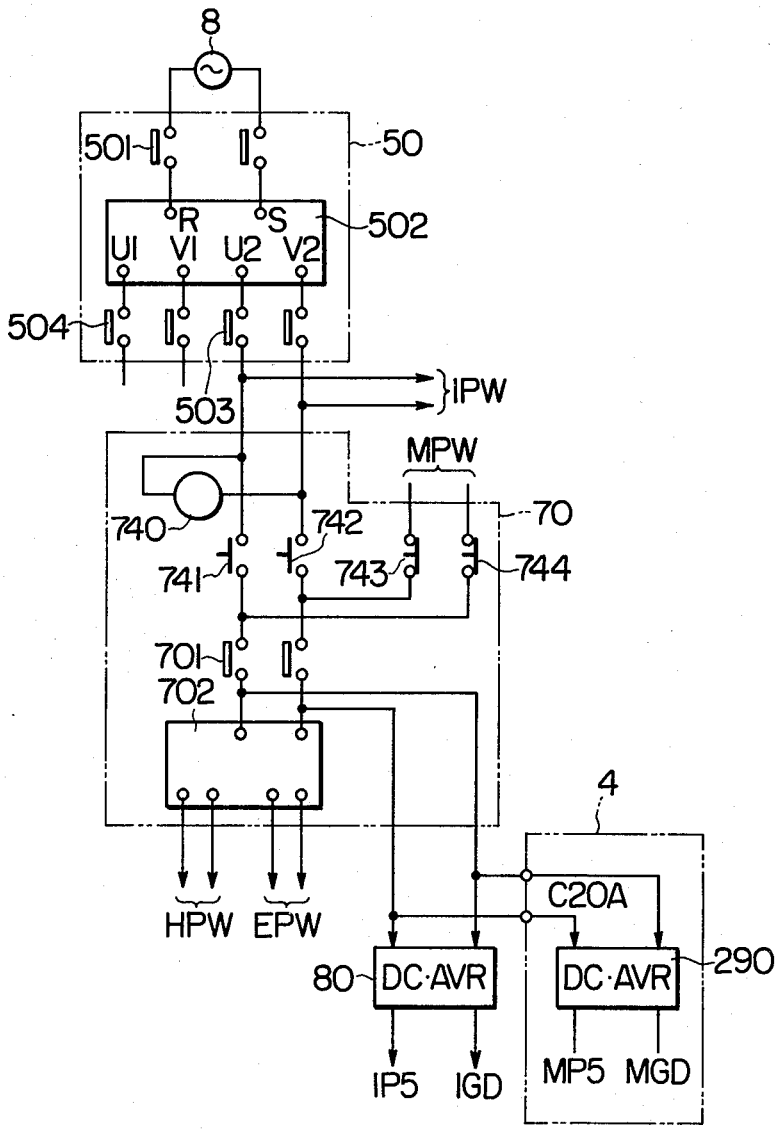
FIG. 2 is an electric circuit diagram of an example of power supply section.

FIG. 2 shows the detail of the power supply section of the #1 elevator car. Other elevator cars can have similar power supply section.

Figure 3:
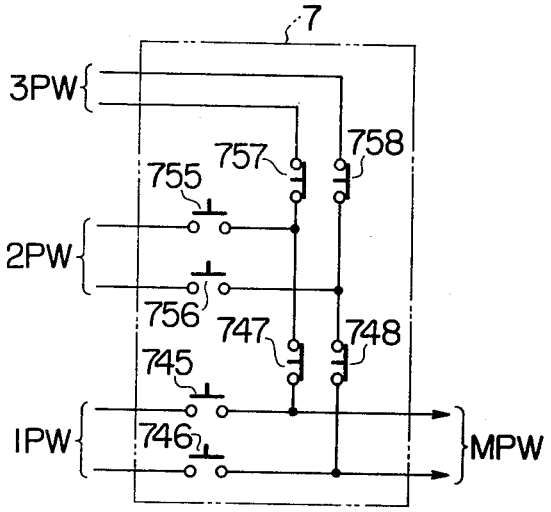
FIG. 3 is an electric circuit diagram of an example of common electric power source circuit.

FIG. 3 shows an example of a common power supply circuit 7 which has been used conventionally.

The lead-in power is supplied to the primary input terminals R, S of a transformer 502, through anon-fuse breaker (referred to as FFB) 501 of an electric source circuit 50. The output derived from secondary output terminals U1 and V1 is delivered to an operation controlling section 60 shown in FIG. 1 through an FFB 504. The output derived from the secondary terminals U2 and V2 is delivered through an FFB 503 to the signal power source circuit 70 and also to the common power supply circuit 7 as 1PW.

The relay 740 as shown in FIG. 3 checks the voltage of the 1PW. In the normal state, the normally-opened contacts 741, 742 and normally-opened contacts 745, 746 (See FIG. 4) of the relay 740 are kept closed, while the normally-closed contact 743, 744 of the same relay are kept opened.

Consequently, in the normal state of use, the power 1PW is imposed on the primary input terminal of the transformer 702, through the contacts 741 and 742 and then through FFB 701. The power 1PW is further supplied, through the connector C20A, to a D.C. automatic voltage regulating circuit D.C. AVR 80. operation car control device, and also to another D.C. AVR incorporated in the system control device 4.

In case of a down of the lead-in power 8 of #1 elevator car due to a trouble in the main circuit such as the driving motor, the relay 740 is released to allow the contacts 741, 742 and 745, 746 (See FIG. 3) to open, while contacts 747, 748 and 743, 744 (See FIG. 2) are closed.

Provided that the power 2PW for the #2 elevator car is alive, the relay contacts 755, 756 of FIG. 3 are closed, so that the power 2PW is delivered as the common power MPW.

Similarly, in case of failure of powers 1PW and 2PW of the #1 and #2 elevator cars, the power 3PW for the #3 elevator is delivered as the common power MPW, because the contacts 757, 758 of the check relay of #2 elevator car and the contacts 747, 748 of the check relay of #1 elevator car are kept opened.

Conventionally, these check relays are mounted in respective control panels. Since there are bridging lines over these panels, the common power MP is lost when the control panel of any one of the elevator cars is removed. However, according to the arrangement as shown in FIG. 2, it is possible to supply the power to the elevator car associated with a control panel, as well as to the common circuit loaded in the same control panel, if the power supply to the panel is available.

Other advantages over the prior art are as follow.

Referring to FIG. 3, in the normal state of operation, the common power MPW is supplied through the contacts 745, 746 of the voltage check relay 740 of the #1 elevator car. However, since the contacts 747, 748 are kept opened for a long period of time, they are likely to be corroded or contaminated by foreign matters. Therefore, when it is desired to supply the common power MPW through 2PW or 3PW, in case of emergency, the power may be failed due to an ill contact of the contacts 747, 748 or 757, 758.

Figure 17:
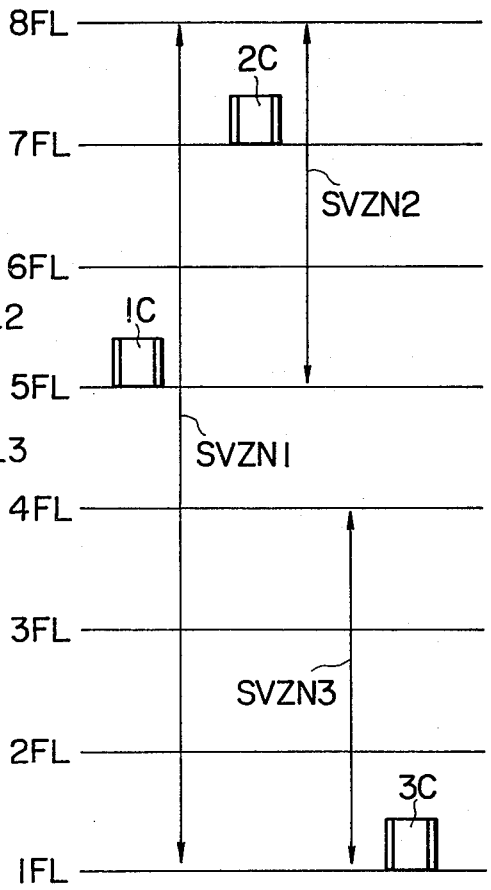

In such a case, all functions of the system control device including hall-call are stopped, in the conventional system. However, in the system of the invention as shown in FIG. 1, it is possible to continue the hall-call service by the #2 and #3 elevator cars, even if the function of the common circuit mounted in the #1 elevator car is failed, if a modification, which will be described later with reference to FIG. 17, is adopted, because the signal power source circuits 71 and 72 of the #2 and #3 elevator cars are driven by their own power supplies 2PW and 3PW.

Figure 4:
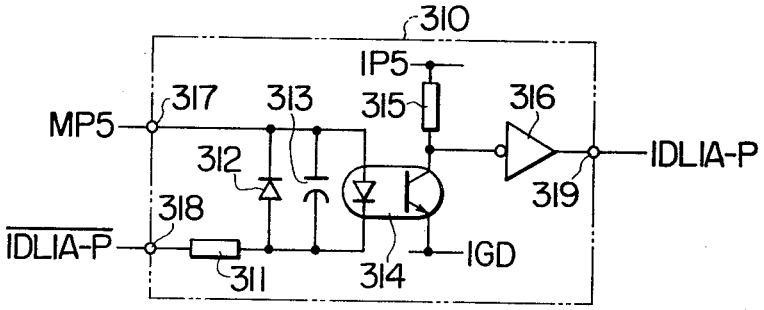
FIG. 4 is an electric circuit diagram showing an example of the receiver.

FIG. 4 shows a practical example of the receiver circuit of the data line. Although the explanation mentions only to the receiver 310, it is to be noted that other receivers 255, 265 and 276 have the same construction.

A power supply MP5 is connected to an input terminal 317, while another input terminal 318 receives the denying signal of the first data line signal 1DL1a-P of the data line 1DL1.

When the level of the input signal 1DL1A-P is "1", i.e. when 1DL1A-P is "L", the MP5 delivers a power to the light-emitting diode of a photo-coupler 314, through a resistor 311, so as to energize the light-emitting diode. As a result, a phototransistor of the photo-coupler 314 becomes conductive, so as to lower the level of an input signal of an integrated circuit (referred to as IC) which tends to become "H" due to the presence of a resistor 315, down to "L". After an inversion by an inverter IC 316, a signal identical to the input signal 1DL1A-P is delivered to an output pin 319.

A diode 312 and a capacitor 313 are provided for protecting the photo-coupler 314 from external noise coming into the data line, and for preventing the same from being operated erroneously.

Figure 5:
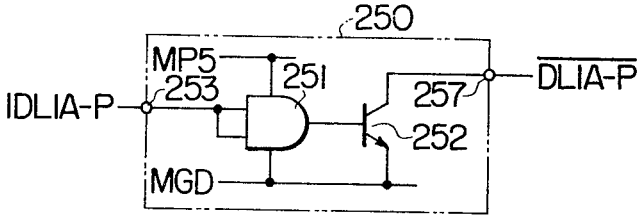
FIG. 5 is an electric circuit diagram of an example of driver.

FIG. 5 shows a practical example of the driver circuit of the data line.

Drivers 250, 260 and 270 are used in the output section of the transmission control circuit 340. FIG. 5 shows, however, the driver for the data line 1DL1A-P. As the input signal 1DL1A-P delivered to the input terminal 253 comes to assume the "H" level, an IC 251 turns a transistor 252 on, so that an inversed signal 1DL1A-P is derived from an output terminal 255.

Figure 6:
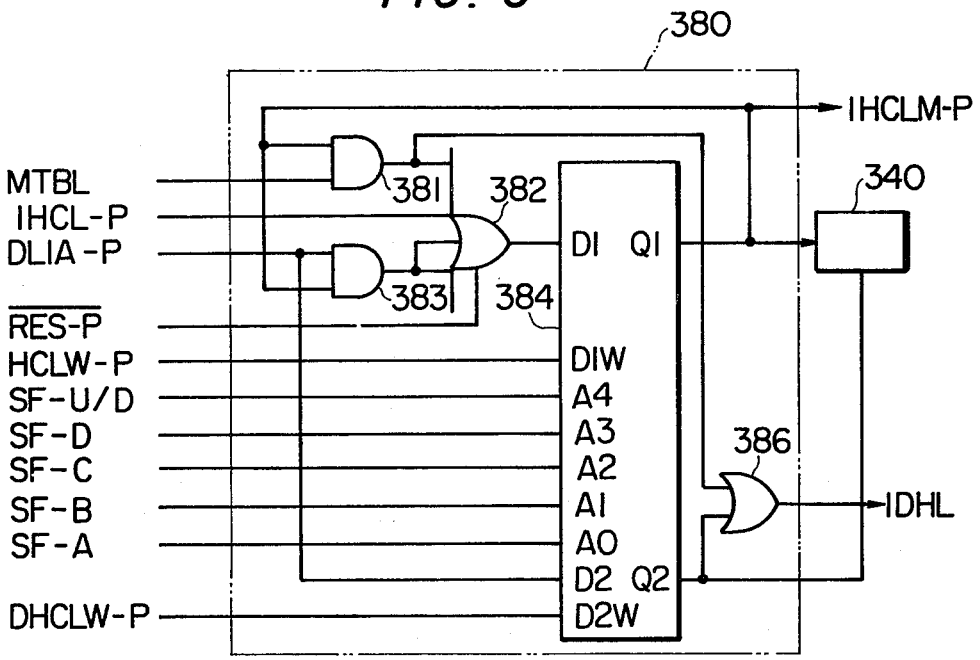
FIG. 6 is an electric circuit diagram of an example of memory circuit.

FIG. 6 shows a practical example of a memory circuit 380 which constitutes the main part of the signal processor 30. This memory circuit 380 is a circuit in which the hall-call is registered, and is constituted mainly by a random address memory 384 which is adapted to be address-controlled by scanning pulses SF-A to SF-D and SF-U/D. As a signal is received by a write control terminal D1W of the random address memory 384, the signal available at the input terminal D1 is written in an address corresponding to the scanning pulse signal of the address input, and the written signal reads out the signal stored in the address corresponding to the address input.

Figure 7:
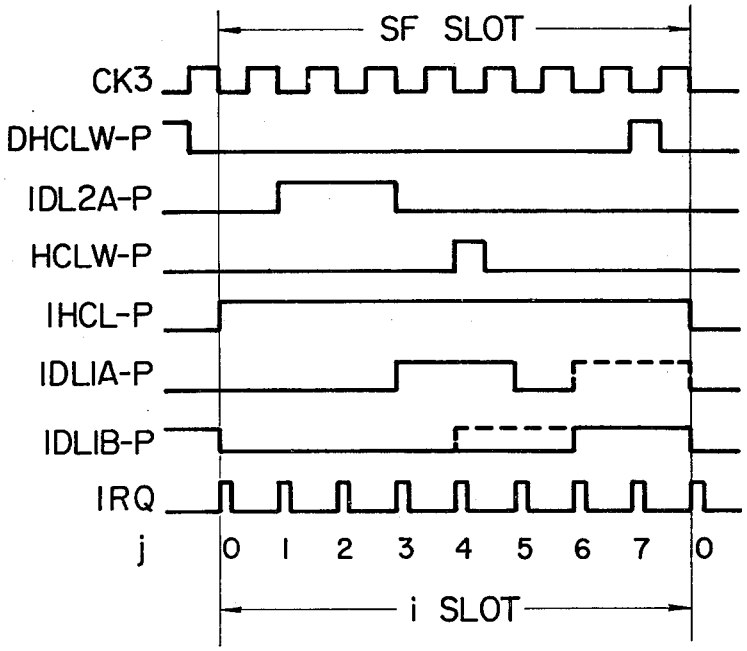
FIGS. 7 and 8 are time charts for explaining the operation of the circuit as shown in FIG. 1, FIGS. 9 and 12 are flow charts showing the flow of processing performed by an M device.
Figure 8:
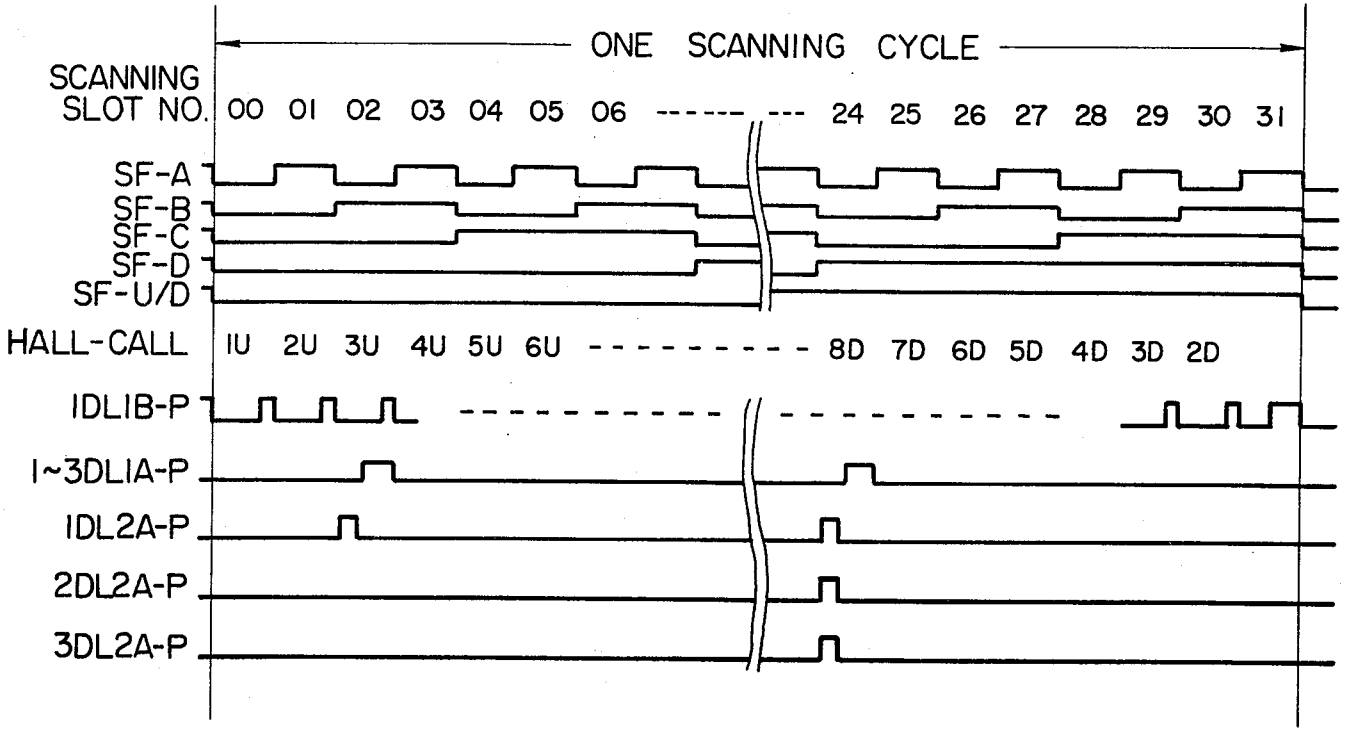

FIGS. 7 and 8 are time charts of time-dividing processing made by the signal processor 30, hall-cell interface control circuit 15 and the system control device 4. The PIA 240 receives the signals from the transmission control circuit 340 through the receiver 255 and supplys the treated signals through the driver 250 to the receiver 310. The CPU receives the signals from the PIA 240 to treat them.

trolling circuit 16. Thus, the interface unit 40 comprises the hall-call interface controlling circuit 15 and the observation panel interface controlling circuit 16.

An output from the lead-in power 8 is supplied to the elevator car controlling section 60 and the signal power source circuit 70 through the electric source circuit 50 as well as supplied to the common power supply circuit 7 as 1 PW. The power 1 PW is supplied, through a connector C20A, to the D.C. automatic voltage regulating circuit (referred to as D. C. AVR) 80 adapted to supply driving powers 1P5 and 1GD to the circuit part such as IC of each elevator car operaton control device, and to another D.C. AVR 290 adopted to supply driving powers MP5 and MGD, incorporated in the system control device 4.

The signal processor 30 has a receiver 310, scanning pulse generating circuit 330, a transmission control circuit 340, a oscillation circuit 350, a failure detecting circuit 370, the memory circuit 380 which memorizes the hall-call signals.

The system control device 4 comprises a microprocessor section 20, drivers 250, 270 and receivers 255, 265, 275 and the D.C. AVR 290.

The microprocessor which occupies a major part of the system control device 4 is constituded by a peripheral interface IC (referred to as PIA) 240, a central processing unit (referred to as CPU) 215, a readonly memory (referred to as ROM) 220 in which the processing procedure is written, a random access memory (referred to as RAM) 230 adapted to memorize the data transmitted from the elevator cars and results of the processing made by the CPU, and an oscillation circuit 210 adapted to produce a clock CK1 which is delievered to the CPU 215. These parts are interconnected by means of signal line BUS constituted by data BUS and adress BUS.

First of all, the points of improvement will be described through a comparison of the conventional system and the system of the invention as shown in FIG. 1.

One of the points of improvement resides in a fact that the protective maintenance is much facilitated. Conventionally, the system control device 4 has been mounted in a separate panel, because it has some hundreds of relays and several tens of printed circuit boards. According to the invention, however, the system control device is constituted by a micro processor, and each of the elevator car operation control devices 1 to 3 is provided with the signal processor 30 to 32, so that a large number of controlling signals such as cage-position signal, cage-calling signal, running signal and so forth are serial-transmitted by means of data lines 1DL1–3DL1 and 1DL2–3DL2. Consequently, the system control device can be formed into small units of a number corresponding to that of the printed circuit board.

According to the invention, therefore, the system control device is annexed to the elevator car operation control device 1 for the 1 elevator car, and is mounted in the same panel. Further, the elevator car operation control devices 2, 3 for the 2 and 3 elevator cars are provided with connectors C21A, C22A adapted for supplying power to the system control device 4. The system control device 4 annexed to the elevator car operation control device 1 for the 1 elevator car can be shifted to the elevator car operaton control devices of other elevator cars, by inserting the unit such as a printed circuit board on which the system control device is mounted and then inserting the data line connectors C20B, C21B, C22B to the system control device 4, as shown in FIG. 21. The time required for this shifting is as short as several minutes.

An interface unit 40 for making an interface for the hall-call register 5 and the observation panel 6 can be treated in the same manner as above. This is, in case of an inspection or repair of operation controlling circuit or the renewal of the whole part of the car operation control device device 1, all what is required is to simply withdraw the interface unit 40 from the connector C40A and to insert it into the connector C41A or C42A of the #2 or #3 elevator car, as shown by broken line.

The second point of improvement resides in that the system of the invention has various back up systems. More specifically, in case of a trouble in the common power supply circuit 7, the signal power source circuits 70–72 are used for backing up. Similarly, the signal processor 30 is used for the backing up purpose in case of a trouble in the system control device 4. Further, the interface unit 40, through which the signals are delivered and received is backed up in a systematic manner as will be described latter. Although the perface backing up as performed by double or triple systems cannot be expected, it is possible to avoid at least the long suspension of service of all elevators.

In sharp contrast to the conventional arrangement of the prior art, in the embodiment of the invention as shown in FIG. 1, the common signal such as hall-call signal is delivered through one of the elevator car operation control devices 1 to 3. This may appear to increase the possibility of the trouble. Although a detailed description will be made later with reference to FIGS. 14 to 18, this question is unfounded as will be understood from the following brief explanation.

(1) According to the arrangement of the embodiment, at least one of the elevator car operation control devices receives the common signal directly, by-passing the system control device 4. The chance of trouble is reduced, as far as the elevator car control device is concerned.

(2) In case of the breakdown of all elevator car operation control device, the whole elevator system becomes inoperative, in either of the elevator systems shown in FIG. 1. If the interface unit as shown in FIG. 1 is provided not only in the elevator car operation control device 1 for the #1 elevator car, but also in the elevator car operation control device of other elevator cars, as will be described later, a superior backing up facility is obtained.

In case it has become impossible to register the hall-call due to a breakdown of the signal processor 30 of the #1 elevator car, the safe operation car be recovered by simply shifting the interface unit 40 to another elevator car operation control device in the manner described before, so that the down time is largely shortened as compared with the conventional arrangement, even when the interface unit 40 is provided in only the elevator car operation control device for the #1 elevator car as shown in FIG. 1.

Further, it is to be pointed out that the trouble in the operation controlling sections 60–62 which constitute major parts of the elevator car operation control device 1 does not interrupt the inputting and outputting of the signals such as hall-call.

In addition, it is considered that the system control device is still not so reliable as the signal processor 30 and other part, even if it is constituted by a micro processor. Therefore, in view of the advantage as stated in The operation cycle of the micro processor 20 is determined by the period of the clock CK1. For a prompter processing of a larger number of data, the frequency of the clock CK1 is preferably the maximum resonant frequency of the microprocessor 20.

The period of processing of the signal delivered from the PIA 240 through drivers 250, 260, 270 and the period of processing of signal received through the receivers 255, 265, 275 are made only at a small speed, because the high-frequency noise coming into the data line having a length of several to several tens of meters is made by the receiver.

The processing speed is limited also by the threshold operation period of the interface controlling circuit 15 which performs parallel and series processing (this will be described in detail later) of the signal.

Further, a failure detecting circuit 370 of the system control device 4 checks the presence of a periodical pulse delivered by the system control device 4. Therefore, the speed of the processing of the signal made by the micro processor 20 has to be sufficiently low as compared with the clock CK1.

For this reason, there is provided a pulse generating circuit 205 which can produce pulses of a constant period by demultiplying the clock CK1. The output pulse IRQ of this circuit is connected to an interruption terminal of PIA 240, so that the micro processor may be actuated at a constant period by the interrupting pulse IRQ, thereby to effect the processing of input and output signal periodically.

FIG. 8 shows the whole part of the scanning cycle for making a scanning corresponding to the hall-calls 1U to 7U and 8D to 2D, while FIG. 7 is a high-speed time chart in a scanning slot.

Symbol CK3 represents a clock pulse generated by the oscillation circuit 350. This clock pulse CK3 is demultiplied by a scanning pulse generating circuit 330. A decoding from the demultiplied pulse is made as required, so that various pulses as shown in FIG. 7 are produced and delivered to the memory circuit and the transmission control circuit for a time division processing.

The failure detecting circuit 370 detects a synchronizing pulse from the pulse 1DL1B-P which is a signal carried by the second line of the data line 1DL1 from the system control device 4. The detected synchronizing signal is delivered to the scanning pulse generating circuit 330, for a synchronization with the system control device 4.

Figure 9:
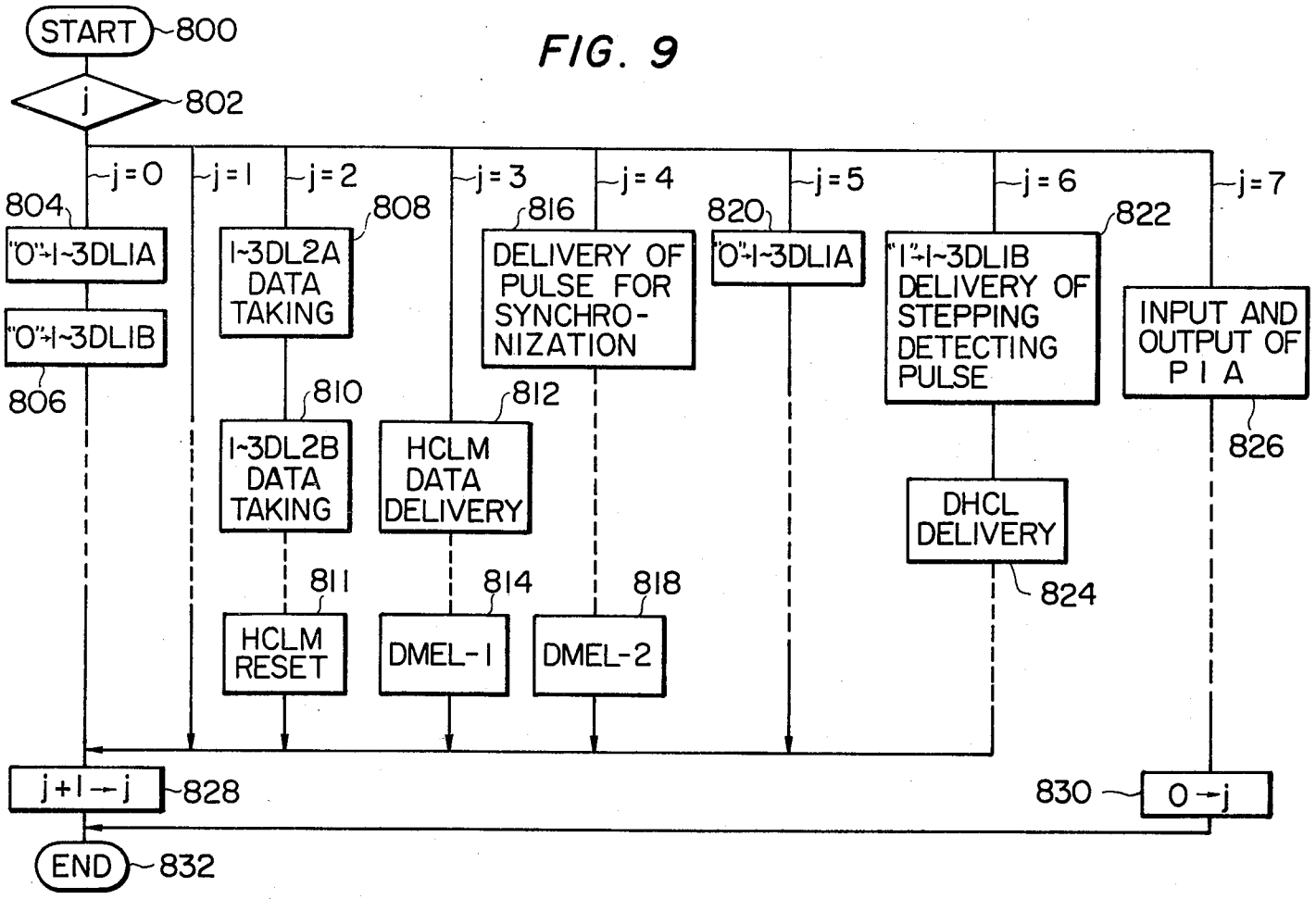
Figure 10:
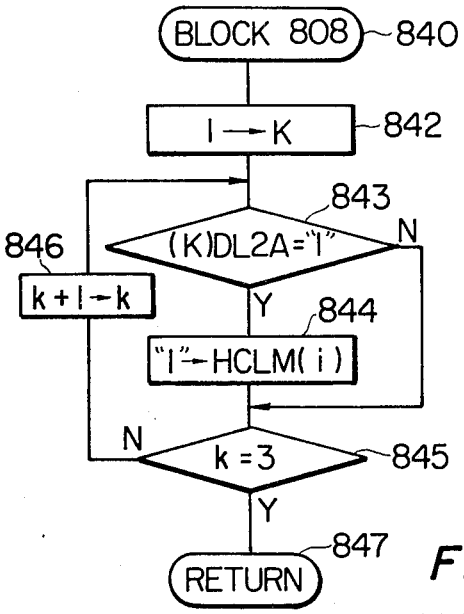
Figure 11:
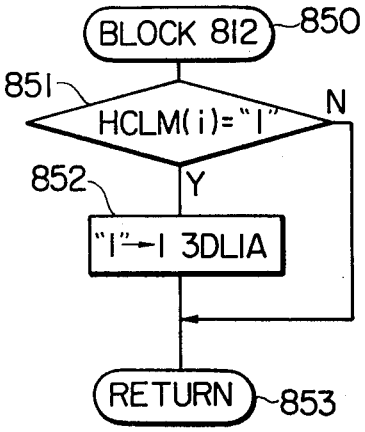
Figure 12:
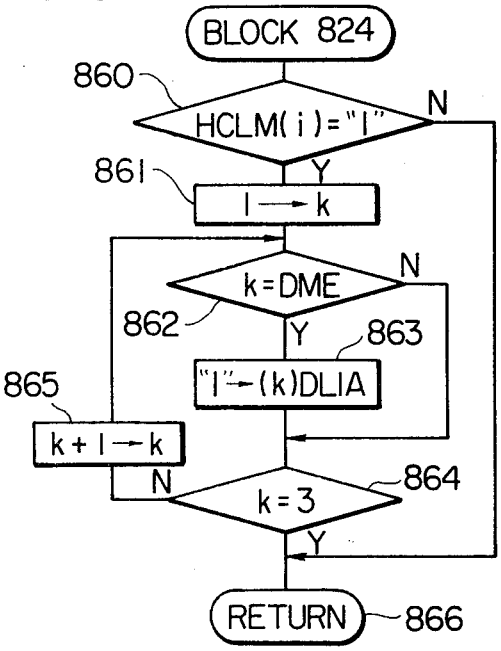

FIG. 9 shows a general flow chart of the micro processor 20, while FIGS. 10 to 12 show parts of detail flow chart which are essential for the understanding of the present invention.

Hereinafter, the operation will be described in detail mainly with reference to the general flow chart as shown in FIG. 9.

An interruption to the micro processor 20 is made by the edge portion of rising of the interrupting pulse IRQ which is produced at a constant period as shown in FIG. 7, thereby to trigger the START 800 as shown in FIG. 9.

Assuming that the interruption number j equals to 7, at first the processing of the block No. 826 is performed, so that the input and output of respective ports of the PIA 240 is performed. Subsequently, the interruption number j is cleared by the block No. 830 to make the same zero. Various processings can be inserted to the portion shown by broken line as required. However, it is necessary that the total processing time is shorter than the period of the interruption pulse IRQ. As the processing of the block No. 830 is over, the processing by the micro processor is tentatively stopped, so as to wait for the interruption signal or the like.

Then, the blocks Nos. 804 and 806 are performed by the interruption pulse IRQ of $J=0$ of FIG. 8, so that the signal "0" is transmitted without fail to all data lines coming from the system control device 4. Consequently, the data line signals 1DL1A-P and 1DL1B-P are made zero (0) when j equals to 0.

Subsequently, the block 828 adds 1 to j, and the processing proceeds to END of block No. 832.

Then, blocks Nos. 808 and 810 performed by an interruption of $j=2$, so that all data delivered by the elevator operation controllers 1 to 3 through the data line are taken up and stored temporarily in the RAM 230.

A control is made by the transmission controlling circuit 340 that signal is delivered over the period of $j=1$ and $j=3$, so that the data may be taken up without fail.

The signal transmitted at this time includes at least the signal representing that the button 700 of the hall-call register is operated. The data line signal 1DL2A-P represents that the hall-call push button 700 for ascending at third floor has been depressed, so that the pulse resides in the earlier half of the scanning slot 02.

FIG. 7 shows an enlarged time chart of the scanning slot 02.

Although neglected from the drawings, elevator car position signal and other signals are delivered to the second data lines 1DL2B-3DL2B of the data line 1DL2-3DL2.

Subsequently, the block No. 811 is performed to control whether the hall-call signal as produced by the block No. 808 is to be reset. More specifically, in response to the registered hall-call, it is judged that whether any one of the elevators has served for this hall-call, and the registered hall-call signal HCLM (i) is cancelled. Then, 1 (one) is added to the interruption signal j, at the block No. 828, so that the processing with $j=3$ may be made in the next time of processing. Finally, the processing is ceased at the block No. 830.

A practical example of the processing made by the block No. 808, which performs the hall-call registration essential for the invention, will be described in detail with reference to FIG. 11.

As mentioned before, hall-call registration signal is delivered to the data lines 1DL2A-3DL2A, at an instant of $j=2$, as shown in FIG. 7 and as explained before.

Since it is not forecast from which elevator car the hall-call signal is input, the function as shown in FIG. 10 is to check the data lines of #1 to #3 elevator cars in sequence, and, when there is a hall-call signal of level "1" in at least one of the data lines, to register this signal as the hall-call signal HCLM (i).

Hereinunder, an explanation will be made as to why the hall-call is constituted by the logical sum of the data lines of all elevator cars, with specific reference to FIG. 1.

Figure 14:
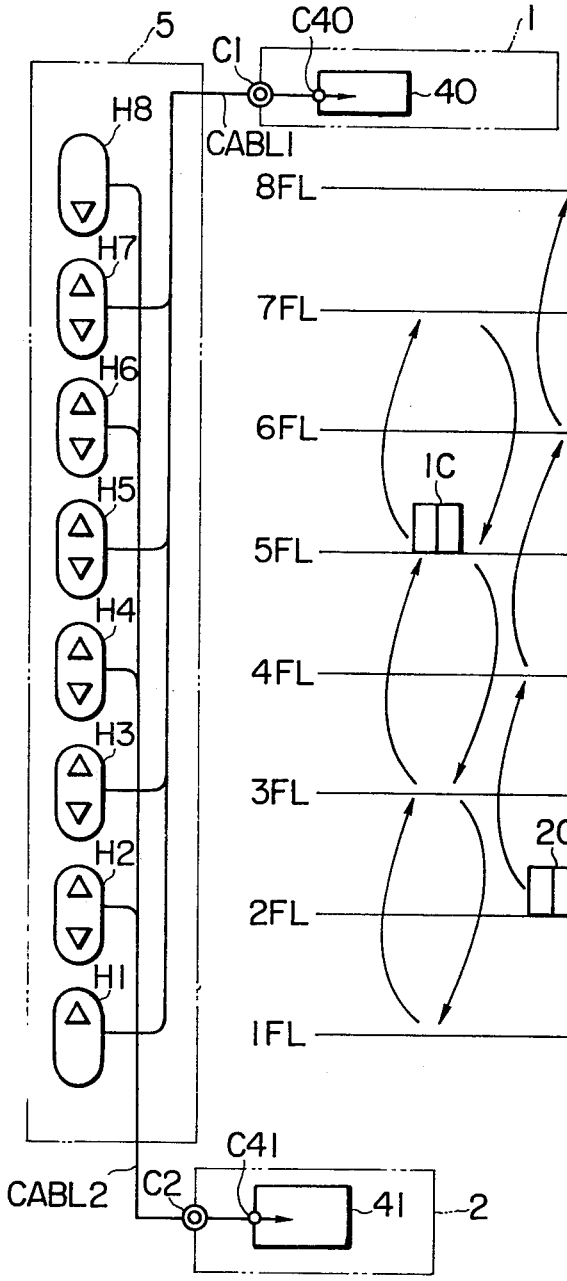
FIGS. 14 and 15 show another embodiment of the invention.

In the system as shown in FIG. 1, the hall-call button 700 is connected only to the elevator operation control device 1. Therefore, for making the hall-call signal, it is required to check only the data line of #1 elevator car. However, in some cases, it becomes necessary to shift from the #1 elevator car to #3 elevator car, for the reason concerning the construction at the site, inspection, repair or the like of the #1 elevator car or the like reason. In addition, in some cases, the hall-calls of a plurality of elevator cars are distributed as shown in FIG. 14 and FIG. 17. Therefore, the check of the data line of #1 elevator car solely is insufficient.

In the flow chart, symbols represent the following matters, respectively.

i: an integer representing hall-call coinciding with the number of scanning slots as shown in FIG. 8.

j: an integer representing the interruption number.

K: an integer instructing the number of elevator car to be processed.

N: abbreviation of No.

Y: abbreviation of yes.

HCLM(i) signal representing the hall-call under processing.

DME: disposition elevator car number

DHCL: disposition hall-call signal

As the block 840 is started, the block No. 842 makes the integer 1 (one).

Since k equals to 1, (k) DL2A in the block No. 843 represents 1DL2A. At the same time, the level of the data line signal 1DL2A-P of the #1 elevator car is "1". Therefore, it is judged "YES". As a result, the block No. 844 is performed. Since it is assumed that i equals to 2, the ascending hall-call signal of the third floor HCLM (2) is made "L".

Subsequently, the block No. 845 judges whether the integer k has reached 3. Since k is still "1", the result of judgement is "NO". Then, "1" is added by the block No. 845, and the block No. 843 is performed again with k=2. At this time, it is judged whether the data line signal 2DL2A of #2 elevator car is "1" (calling). As will be seen from FIG. 8, the result of judgement is "0", so that the processing proceeds to the judgement by the block No. 845, without performing the block No. 844. The block No. 845 is making a judgement of k=3. In case that there are 6 parallel elevator cars, the above stated processing is repeated six times, until the value of integer k becomes 6.

FIG. 10 shows the judgement made when k equals to 3. Therefore, the hall-call registration signal HCLM (i) becomes "1", when the logical sum of the hall-call registration signals of the #1 to #3 elevator cars is "1", and "1" is written in the predetermined address of the RAM 230 of FIG. 1.

Then, as the block No. 800 is started by the interruption of j=3, the route of j=3 is selected by the judgement of j made by the block No. 802. Then, the block 812 is performed, which has a function to send the hall-call which has been registered by the flow as shown in FIG. 11 which is triggered, as stated before, by the block No. 808, and has not been erased by the block No. 811, back to respective elevator car operation control devices.

The detail of this flow is shown at FIG. 11.

The block No, 851 judges that HCLM(i)="1", and the block No. 852 instructs the address of the PIA 240, through the BUS as shown in FIG. 1, and "1" is set through the BUS. Once the "1" is set, the signal 1DL1A-P continues to send "1", as shown in FIG. 7, until the time of reset processing made by the block No. 820.

The reason why the registered hall-call signal HCLM (i) is sent back to the elevator car operation control devices is as follows.

Figure 16:
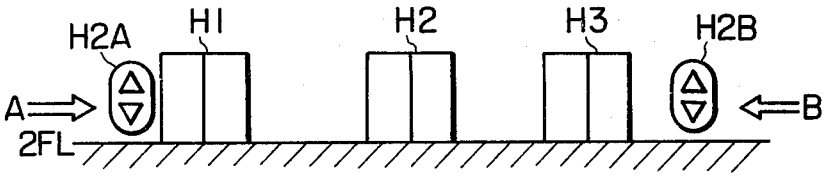
FIGS. 16 to 17 show still another embodiment of the invention.

This is, in some cases, the hall-call response lamps 800 are connected to #2 elevator car, for the various reasons as stated before. Particularly, when there is two hall-call registers in one elevator floor as shown in FIG. 16, or when a plurality of registers are connected separately to corresponding elevator cars, it is necessary to put the response lamps at both sides, when one of the buttons is depressed.

Then, the block No. 814 performs a selection of the elevator car to which the hall-call is applied.

Usually, the time required for this processing is considerably long, so that the processing cannot be completed within one interruption period. Therefore, the subsequent processing is made by the block No. 818 of j=4. It is necessary, however, to divide the processing DMEL into DMEL-1 and DMEL-2, such that the maximum total processing time for J=3 made by the block No. 814 falls within the period of the interrupting pulse IRQ shown in FIG. 7. In some cases, only the block No. 814 is required. If it is desired to make a high degree of disposition, it is necessary to add the processing DMEL-3 to the route of j=5, as well as the block No. 818.

As the processing DMEL-1 of the block No. 814 is completed, "1" is added by the block No. 828 of j, so as to make j=4, and the processing is finished by the block No. 832 END.

Then, as an interruption pulse is introduced, the block No. 816 is performed. At this time, "1" is set in the data lines 1DL2B-3DL2B of each elevator car, when the number i is 31. This signal "1" is a pulse for synchronization, which is delivered to set at 00 the slot numbers of scanning pulse generating circuit 330 and so forth in the system control device 4 and in the signal processors 30-32 of each elevator car.

As the setting is made at "1" with j=4, the signal 37 1" is maintained until it is cleared to "0" by the performance of the block No. 806 of the j=0 route. Therefore, the data line signal 1DL1B-P is a pulse having a large pulse width as shown by broken line in FIG. 8 and as the scanning slot 31 of FIG. 8.

The fact that the pulse width of this pulse is large is detected by the failure detecting circuit 370 and so forth incorporated in the signal processors 30–32 of respective elevators, from the fall of this pulse, and a preset pulse is sent to the scanning pulse generating circuit 330 and so on for making the number 00.

Subsequently, as an interrupting pulse is received, the route of j=5 is selected, and the block No. 820 is performed. This made to clear the data transmitted by the block No. 812 to zero.

As another interrupting pulse is received, the route of j=6 is selected, so that the block No. 822 is performed. Consequently, a stepping detecting pulse for advancing the scanning slot of each elevator car by 1 (one) is delivered. As this pulse falls, the high speed portion of the scanning pulse of each elevator is preset to "0".

However, the forcible stepping of the scanning pulse which is made through the presetting of the high-speed portion of scanning pulse at "0" by the stepping detecting pulse can be dispensed with, if the clock pulses CK1 and CK3 derived from the oscillation circuit 210 of the system control device 4 and the oscillation circuits 350 and so on are accurate and stable enough.

In such an elevator system, the stepping detecting pulse cannot be transmitted in the correct mode. For instance, the stepping detecting pulse is not transmitted at all or not reset to "0" or the pulse width is too large or small or the period is too long or short. Such an incorrect mode of transmission of the stepping detecting pulse is detected by the failure detecting circuits 370 and and so on of respective elevator cars, and a system control device failure signal MTBL is delivered by these failure detecting circuits. As a result, the managing of elevator group is dismissed and the control is switched for an independent operations of respective elevator cars.

For instance, as shown in FIG. 6, AND gate 381 becomes "1", and the hall-call signal 1HCL-P is made to pass as a hall-call registered signal 1HCLM-P through the AND gate 381. This signal is then delivered through OR gate 382 and the AND gate 383, and is finally held. This holding is continued until the reset is made by a hall-call erasing pulse RES-P which is issued when the elevator car concerned has served for the hall-call.

Subsequently, the block No. 824 is performed. The detail of this processing is shown in the flow chart in FIG. 12.

The block No. 860 judges whether there is any hall-call registration HCLM (i) under processing. When there is a call, the block No. 862 detects the elevator which is identified by the elevator No. DME selected by the blocks Nos. 814 and 818. Then, the block No. 863 sets "1" in the data line (k) DL1A of the associated elevator car, so as to form a disposition hall-call pulse which takes "1" level over a period of j=6 to J=7, in the data line signal 1DL1A-P as shown by broken line in FIG. 7.

The route of j=7 is selected as another interrupting pulse is selected.

The micro processor 20 repeatedly performs at least the processing described in connection with FIGS. 11 to 12.

The elevator car operation control devices 1 to 3 as used in the elevator system as shown in FIG. 1 can be used as the controller for the elevator cars which are installed separately or independently. The controller of the invention incorporates various parts which would not be necessitated for independently or separately installed elevator cars. These parts are: the relay 740 and its associated contacts and wirings in the signal power source circuit 70, circuits for interface with the system control device 4 and for synchronization of the scanning pulse, means for detecting the failure of system control device and for preventing the registration of hall-call, space for accomodating the system control device 4 consisting of several sheets of printed circuit boards, and connectors C20A to C22A for the power supply. However, it is more expensive to design, produce, manage and maintain two different controllers, than to provide these parts in the controller.

From another point of view, the modification of elevator system from separate elevator system to parallel elevator system facilitated considerably.

Figure 15:
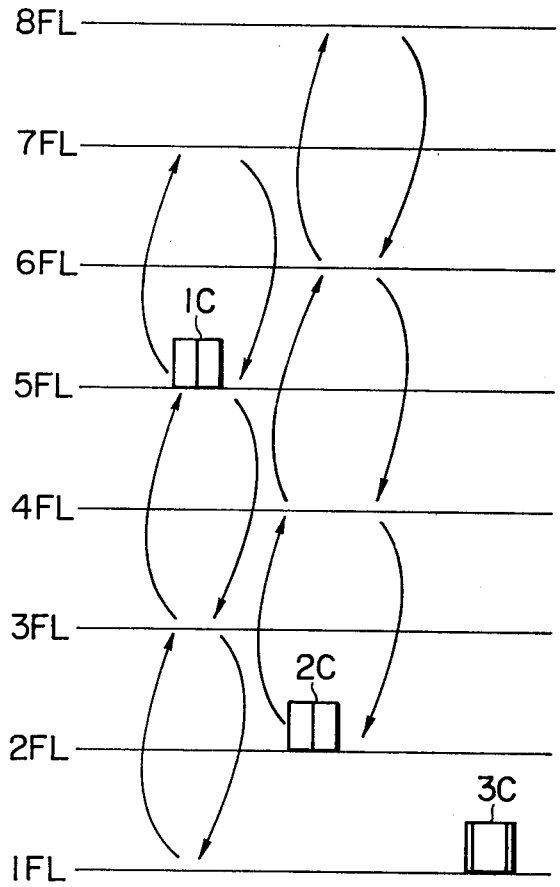

Hereinafter, a second embodiment of the invention will be described with specific reference to FIGS. 13 to 15.

This second embodiment is characterized in that, as shown in FIG. 14, every other hall-call registers 5 of the 8 (eight) hall-call registers 5, each provided in each of the first to 8 th floors, are grouped into respective groups and connected to the elevator car operation control devices 1 and 2 of #1 and #2 elevator cars.

According to this arrangement, when the system control device 4 has become out of order, the mode of control of the elevator car operation control devices is switched to an independent control, such that 1C and 2C of the #1 and #2 elevators cars serve for the hall-call at odd-number floors and even-number floors, respectively.

At the same time, since the #3 elevator car has no hall-call alloted thereto, it waits for the customers with its door opened, at the ground floor in which the number of passangers is specifically large, when the level of the MTBL becomes "1" as a result of detection of failure of the system control device. It will be seen that all of the three elevator cars can serve substantially equally for all traffic needs.

Figure 13:
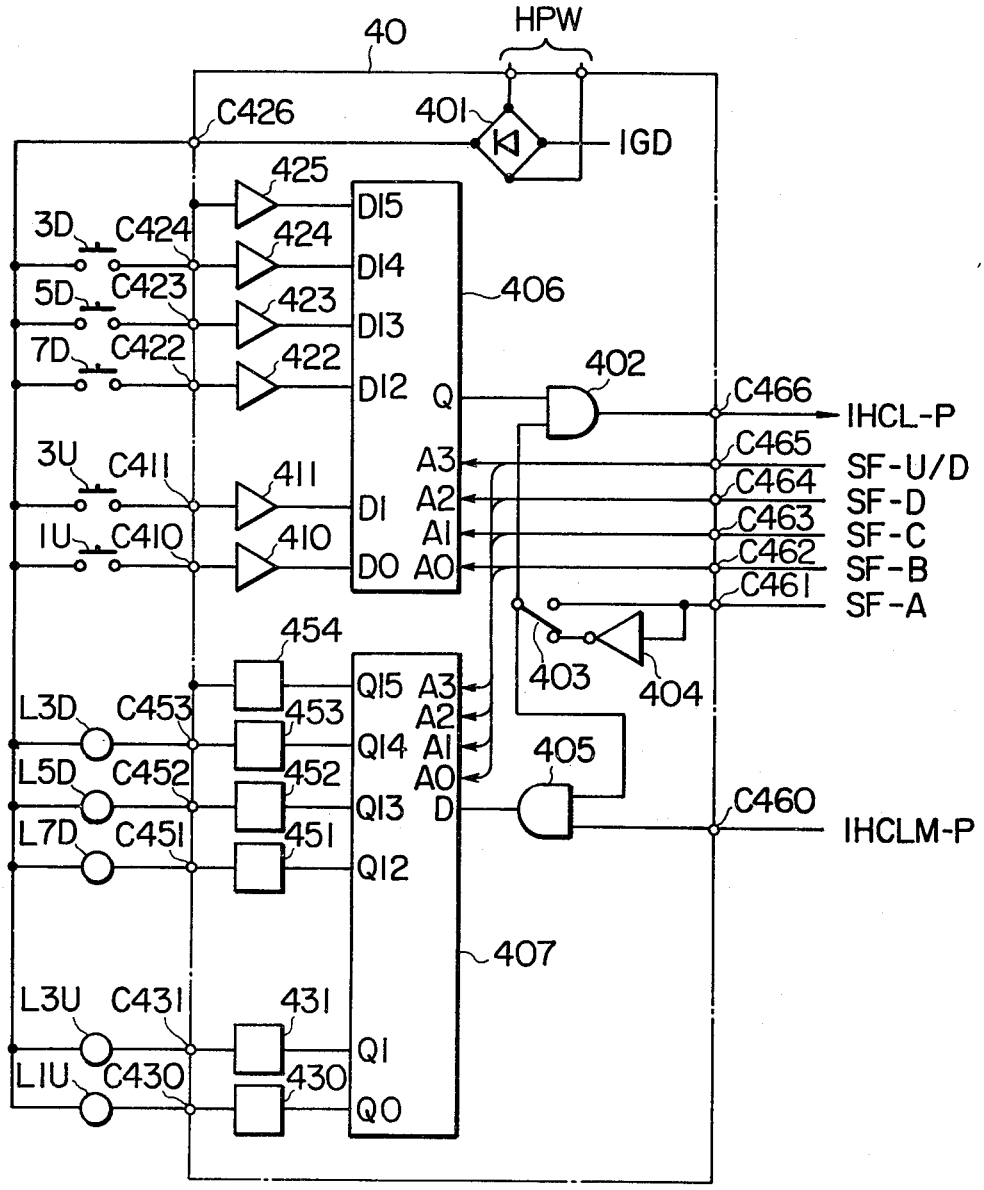
FIG. 13 is a circuit diagram of an example of the interface circuit with the hall-call register.

FIG. 13 shows a practical example of the interface unit 40 concerned with the hall-call of the #1 elevator car.

Ascending push buttons 1U, 2U of the odd-number floors and descending push buttons 3D, 5D, 7D of odd-number floors are connected to the #1 elevator car. Signals from these push buttons are delivered to the interface unit 40, tthrough corresponding terminals C410 to C426 of the connector C40B.

These hall-call buttons are connected to the elevator control panel through long lines which are liable to incur noises. Therefore, a high-voltage power source different from that for the IC power source is used. In this case, this power source is commonly used also by the response lamps L3D, L5D, L7D . . . L3U, L1U which are installed corresponding to the above-mentioned hall-call.

The A.C. source HPW supplied from the transformer 702 of the signal power source circuit 70 as shown in FIG. 2 is rectified by a fullwave rectifier 401, so as to become a D.C. power which is used for the above-mentioned power source.

Therefore, buffers 410, 411, 412–425 must be operated with a high input voltage and capable of eliminating noises. Also, the output level of these buffers must be low enough to match the level of IC.

In the data selector 406, input data are successively selected (scanned) by the scanning pulses SF-A to SF-U/D which are delivered from the scanning circuit 330. FIG. 8 shows how the scanning pulse is related to the hall-call scanning.

Referring to FIG. 13, an AND circuit 402 has a function to deliver the hall-call pulse 1HCl-P to the memory circuit 380 of FIG. 7, only to the slot corresponding to the odd-number floor, by the AND of the output from the data selector 406 and the floor scanning signal SF-A.

Also, an inverter 404 and a change-over switch 403 are adapted to produce the signal SF-A from the floor-scanning signal SF-A and to make this interface unit 40 usable also in the #2 elevator car, therby to achieve the standardization of the hardware.

The hall-call registration signal 1HCLM-P is delivered by the memory circuit 380 as shown in FIG. 6. Only the pulse corresponding to the odd-number floors are allowed to pass through the AND gate 405. The output from the AND gate 405 is decoded by a decoder 407, so as to drive the response lamps through the drivers 430, 431, 451–454.

Although in this embodiment the registers of every other floors are grouped, this is not exlusive. For instance, registers of every three floors may be grouped and connected to respective one of three elevator cars.

Figure 18:
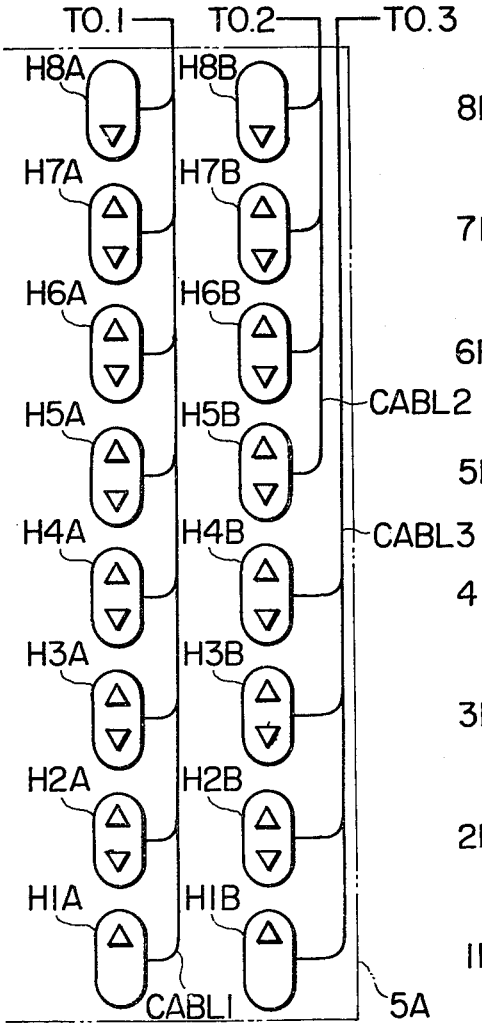

Hereinafter, a third embodiment of the invention will be described with reference to FIGS. 16 to 18.

This third embodiment is characterized in that, when there are two hall-call registers 5 in each floor as shown in FIG. 16, these registers are connected to different elevator cars in a duplicate manner as shown in FIG. 17.

According to this arrangement, when the system control device 4 has happened to be failed, each elevator car can have its own service zones SVZN1–SVZN3, so as to cope with the traffic demand in combination.

Further, the duplicate connection offers the following advantages.

(1) Even when the IC power source D.C. AVR80-82, signal processor 30–32 or the interface unit 40 of the elevator car having the interface with the hall-call has happened to be failed, the passanger can register his hall-call in the system control device 4, through other elevator car by depressing the hall-call button at the other side of the same floor.

(2) The inspection and repair of the hall-call register itself can be made easily by simply disconnecting the connector C40B to which the bundle of cables CABL1-3 for the hall-call register is connected. For instance, assuming that the trouble is taking place in the hall-call register H4A, the operator makes an announcement "HALL-CALL REGISTERS OF A-SIDE IS UNDER REPAIR. PLEASE USE THE B-SIDE HALL-CALL REGISTER", around the A-side hall-call registers of each floor, and then disconnects the connector 40CB of the elevator controller of #1 elevator car in the machinery room, for the repair of the register H4A.

For information, it is a common measure, when more than three elevator cars are used, to provide a plurality of hall-call registers for the convenience's sake.

Hereinafter, a fourth embodiment of the invention will be described with specific reference to FIG. 19.

In this embodiment, hall-call circuit common to all elevator cars is provided in the operation controllers of respective elevator cars. Therefore, when the elevator car operation control devices of the elevator cars are inspected, the signal power source circuits 70–72 are alive due to the power supply MPW from the common power source circuit 7. It becomes necessary to withdraw the unit 41P which is a printed circuit board loaded with the IC constituting a part of the operation controlling section 60, while the power 1P5 is supplied from the D.C. AVR 80.

The circuits of these IC are suited for small electric power and low voltage, so that the operator who is engaged in the repair work is not subjected to any danger even if these circuits are alive. However, it is considerable to break the electronic parts such as IC.

Figure 19:
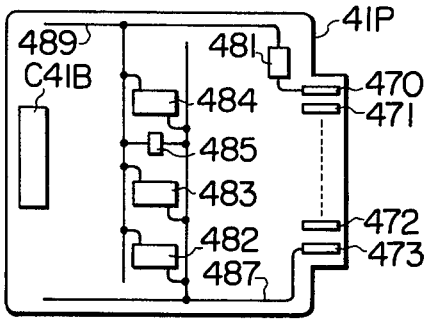
FIG. 19 is a plan view of an example of a printed circuit board as used in the system of the invention.

According to the arrangement as shown in FIG. 19, a capacitor 485 is connected between the power sources, so as to prevent the generation of an extraordinarily high voltage between the power sources, when the unit 41P loaded with IC482–484 is withdrawn.

When the unit 41P is inserted again, a current may rush into the capacitor 485, by a surge voltage imposed by plugs 470, 473. To avoid this, a reactance 481 is interposed between the plug 470 of anode and the anode power supply line 489.

Hereinunder, a supplementary explanation of the invention will be made, specifically from the view point of mounting, with specific reference to FIG. 20.

Figure 20:
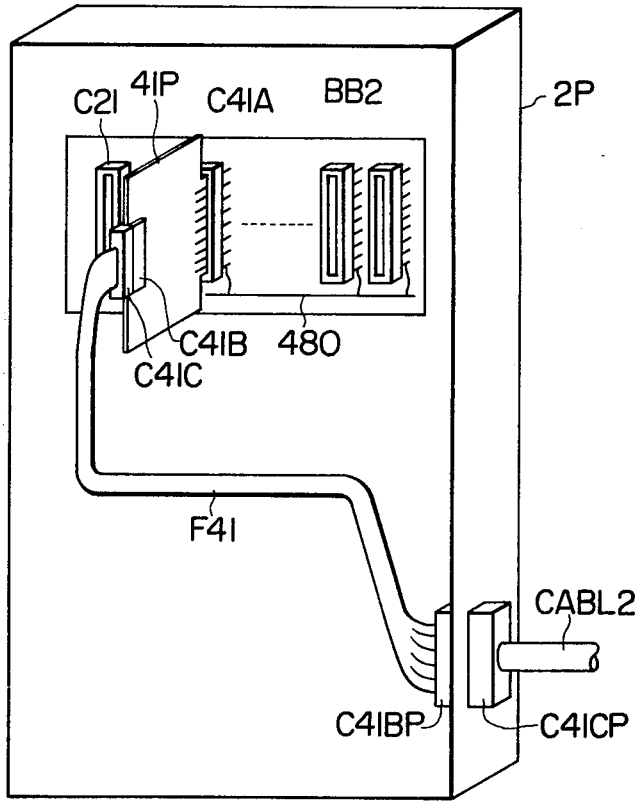
FIG. 20 is a perspective view of an elevator control system in accordance with the invention.

FIG. 20 shows a control panel 2P in which the elevator car operation control device 2 of 190 2 elevator car is mounted. BB2 denotes a backboard printed circuit board adapted to fix the connector for printed substrate in which ICs are mounted and to make the mutual connection by means of copper foil 48 or the like.

The connector C21 is adapted for the insertion of the printed substrate plate 41P in which the system control device 4 is mounted. This plate is not used in the normal state, because it is annexed to the #1 elevator car. However, in case of an inspection, repair or renewal of the control panel of the #1 elevator car, this can be inserted into the connector C21 of the control panel 2P of the #2 elevator car.

The printed board 41P has the hall-call interface unit mounted therein. In the embodiment as shown in FIG. 14, the cables CABL 2 for the connection to the hall-call registers H2–H8 of the even-number floors have larger diameter than the wires in the panel.

These cables are connected to the wires in the panel at the leadin section of the panel, by means of connectors C41P and C41BP. Further, this cable F41 is connected to the circuit in the printed circuit board 41P, through connectors C41B and C41C.

For instance, in case of an arrangement as shown in FIG. 14, the hall-call registers H2–H8 mounted in the #2 elevator car can be shifted to the #3 elevator car, by disconnecting the printed circuit board 41P and the cable F41 and inserting them to the control panel of the #3 elevator car, with withdrawing the cables CABL2 together with the connector C41CP and inserting the connector to the control panel of the 190 3 elevator car.

As has been described, according to the invention, it becomes possible to obtain a system for controlling parallel elevator cars, which is more prepared against troubles and which is more easy to maintain. As to the hardware, the design, management and maintenance of the system are facilitated, while, in the production, the cost is considerably reduced due to a mass production, because the system can be constituted by a corresponding number of standardized elevator control panels.

What is claimed is:

1. An elevator system comprising:

a structure having a plurality of floors, a plurality of elevator cars mounted in parallel for movement relative to the floors, at least two hall-call registration means to register calls for service from the floors, a plurality of elevator car operation control means each of which is respectively provided in each of said elevator cars, for operatively controlling the elevator cars in accordance with signals for service of the elevator cars, system control means to deliver the signals for service of the elevator cars to the elevator car operation control means for systematically controlling the elevator car operation control means, at least two interface means for respectively connecting the hall-call registration means and at least two of the elevator car operation control means to deliver calls for service of the elevator cars received from the hall-call registration means to the elevator car operation control means, and duplicated hall-call registration systems each of which connects, in turn, one of hall-call registration means, one of interface means, one of elevator car operation control means and the system control means.

2. An elevator system of claim 1, comprising: disconnectable connector means for connecting said elevator car operation control means and said system control means.

3. An elevator system of claim 1, comprising:

mounting means for disconnectably mounting the interface means in said elevator car operation control means.

4. An elevator system of claim 1, 2 or 3, comprising:

disconnectable connector means for-connecting the interface means and said hall-call registration means.

5. An elevator system of claim 1, wherein the signal processor includes a failure detecting circuit for said system control means.

6. An elevator system of claim 1, wherein said system control means comprises a peripheral interface receiving the signals delivered from the signal processor and supplying the signals treated in said system control means, a central processing unit receiving the signals from the peripheral interface and treating the signals, a read-only memory writing a treatment procedure, randum access memory to memorize data delivered from said elevator car operation control means and the results treated in the central processing unit and an oscillation circuit to generate clocks given to the central processing unit.

7. An elevator system of claim 1, wherein said hall-call signals are distributed to said plurality of elevator car operation control means for each several floors.

8. An elevator system of claim 1, wherein said hall-call signals are distributed to said plurality of elevator car operation control means for each floor.

9. An elevator system of claim 1, wherein said hall-call registration means is provided in plural in each floor, while each of said elevator car operation control means is provided with its own interface circuit, so that the hall-call signals issued from respective hall-call registration means are distributed to said plurality of elevator car operation control means.

10. An elevator system of claim 1, wherein each of said plurality of elevator car operation control means is provided with an independent power source.

11. An elevator system of claim 1, wherein each of said plurality of elevator car operation control means is provided with a common power supply which is connected each of said plurality of elevator car operation control means.

12. An elevator system comprising:

a structure having a plurality of floors comprising at least a first zone composed of a group of floors having a number of floors less than said plurality of floors, a plurality of elevator cars mounted in parallel for movement relative to the floors, at least two hall-call registration means to register hall-calls for service from said plurality of floors, a plurality of elevator car operation control means each of which is respectively provided in each of said elevator cars, for operatively controlling the elevator cars in accordance with signals for service of the elevator cars, system control means to deliver the signals for service of the elevator cars to the elevator car operation control means for systematically controlling the elevator car operation control means, at least two interface means for respectively connecting the hall-call registration means and at least two of the elevator car operation control means to deliver hall-calls for service of the elevator cars received from the hall-call registration means to the elevator car operation control means.

13. An elevator system according to claim 12, further comprising means for bypassing said system control means to cause said elevator car to respond to said signals for service.

14. An elevator system according to claim 13, further comprising means to cause a first elevator car to respond to signals for service representing hall-calls only from floors within said first zone when said system control means is inoperative.

15. An elevator system according to claim 14, wherein said plurality of floors includes at least a second zone composed of a second group of floors not included in said first zone, and further comprising means to cause a second elevator car to respond to signals for service representing hall-calls only from floors within said second zone.

16. An elevator system according to claim 14 or 15, wherein said plurality of floor includes at least an ingress/egress floor at a ground level and further comprises means to cause a third elevator car to provide service from said ingress/egress floor.

17. An elevator system according to claim 15, wherein individual floors of said first and second zones are contiguous and alternately disposed with respect to each other.

* * * * *